US007059920B2

(12) United States Patent
Billow et al.

(10) Patent No.: US 7,059,920 B2
(45) Date of Patent: Jun. 13, 2006

(54) SPRING CLIP CONNECTOR

(75) Inventors: Don Billow, La Palma, CA (US); Julie Ward, Chino, CA (US); Mike Lin, Cerritos, CA (US)

(73) Assignee: International Connectors & Cable Corp., Cerritos, CA (US)

( * ) Notice: Subject to any disclaimer, the term of this patent is extended or adjusted under 35 U.S.C. 154(b) by 0 days.

(21) Appl. No.: 10/606,165

(22) Filed: Jun. 25, 2003

(65) Prior Publication Data

US 2004/0266275 A1 Dec. 30, 2004

(51) Int. Cl.
*H01R 4/48* (2006.01)

(52) U.S. Cl. ..... 439/838; 439/441

(58) Field of Classification Search ..... 439/838, 439/835, 834, 441, 540, 557, 571, 555, 656
See application file for complete search history.

(56) References Cited

U.S. PATENT DOCUMENTS 6,712,649 B1 * 3/2004 Mano et al. ..... 439/835

OTHER PUBLICATIONS

Brochure of ICC™ Structured Cabling Solutions, Registered to ISO 9001, submitted section entitled Multi-Port Solutions, MPS, (2001) pp. 10-23.
11 sheets of photographs of Magnovox Speaker Wall Plate, Audio, M62073.

* cited by examiner

*Primary Examiner*—Alexander Gilman
(74) *Attorney, Agent, or Firm*—Christie, Parker & Hale, LLP

(57) ABSTRACT

The present invention relates to a spring clip connector assembly comprising a base product with an opening and a spring clip connector. The spring clip connector includes a housing having a front wall with an opening for receiving a wire therethrough, a movable tab located in the housing, and a conductor secured to the housing and having a contact positioned to engage a wire inserted through the opening in the front wall, and a spring between the housing and the tab. One of the base product and the housing includes a resilient member and the other of the base product and the housing includes a mounting surface, the resilient member movable between a first position that permits insertion of the housing through the opening of the faceplate and a second position that engages the at least one mounting surface and blocks removal of the housing from the opening of the faceplate. Further, the tab is movable between a closed position such that a portion of the tab is adjacent to the contact to secure a wire inserted through the opening in the front wall against the contact and an open position such that the portion is farther away from the contact than in the closed position to release the wire, the spring biasing the tab toward the closed position.

21 Claims, 7 Drawing Sheets

SPRING CLIP CONNECTOR

BACKGROUND OF THE INVENTION

There are a variety of connectivity products that can be used to connect wire from audio equipment such as tuners, amplifiers and equalizers to speaker equipment. The most common types of connectivity products are binding posts, banana jacks and plugs and spring clips. Spring clips are particularly desired when used with large gauge stranded wire favored by audiophiles for clarity of signal transmission because the clips crush the strands of the wire, placing as many strands as possible in direct contact with a conductor. Connectivity products are typically provided in pairs, one being marked red and the other being marked black, to identify and aid maintenance of proper polarity in the wiring connections between the output component and the speaker system.

Banana jacks and binding posts are often available as modules, i.e., with the red and black connections as separate components. These multi-port modular solutions involve the mating of the banana jack or binding post module into a faceplate port without the use of solder or screws. Despite the popularity of spring clips, spring clips are only available as a duplex type with two connections mated into a common housing. Some of these duplex modules may be mounted onto faceplates to provide a fixed or pre-configured solution. However, there is a need for spring clips to be provided as modules so that screws or other attachment means requiring installation tools are not required to install them onto a faceplate.

The faceplate port and modular insert concept was developed with the idea of producing a flush face when a voice or data jack was inserted. However, with the expansion of products to include modules that protrude beyond the faceplate, the ability to negotiate the module through the port of a faceplate becomes more difficult. Thus, there is also a need to provide a modular spring clip connector that, while protruding from the port of a faceplate, is easy to install and provides a secure connection.

SUMMARY

The present invention relates to a spring clip connector assembly comprising a base product with an opening and a spring clip connector. The spring clip connector includes a housing having a front wall with an opening for receiving a wire therethrough, a movable tab located in the housing, and a conductor secured to the housing and having a contact positioned to engage a wire inserted through the opening in the front wall, and a spring between the housing and the tab. One of the base product and the housing includes a resilient member and the other of the base product and the housing includes a mounting surface, the resilient member movable between a first position that permits insertion of the housing through the opening of the faceplate and a second position that engages the at least one mounting surface and blocks removal of the housing from the opening of the faceplate. Further, the tab is movable between a closed position such that a portion of the tab is adjacent to the contact to secure a wire inserted through the opening in the front wall against the contact and an open position such that the portion is farther away from the contact than in the closed position to release the wire, the spring biasing the tab toward the closed position.

DETAILED DESCRIPTION

Figure 1:
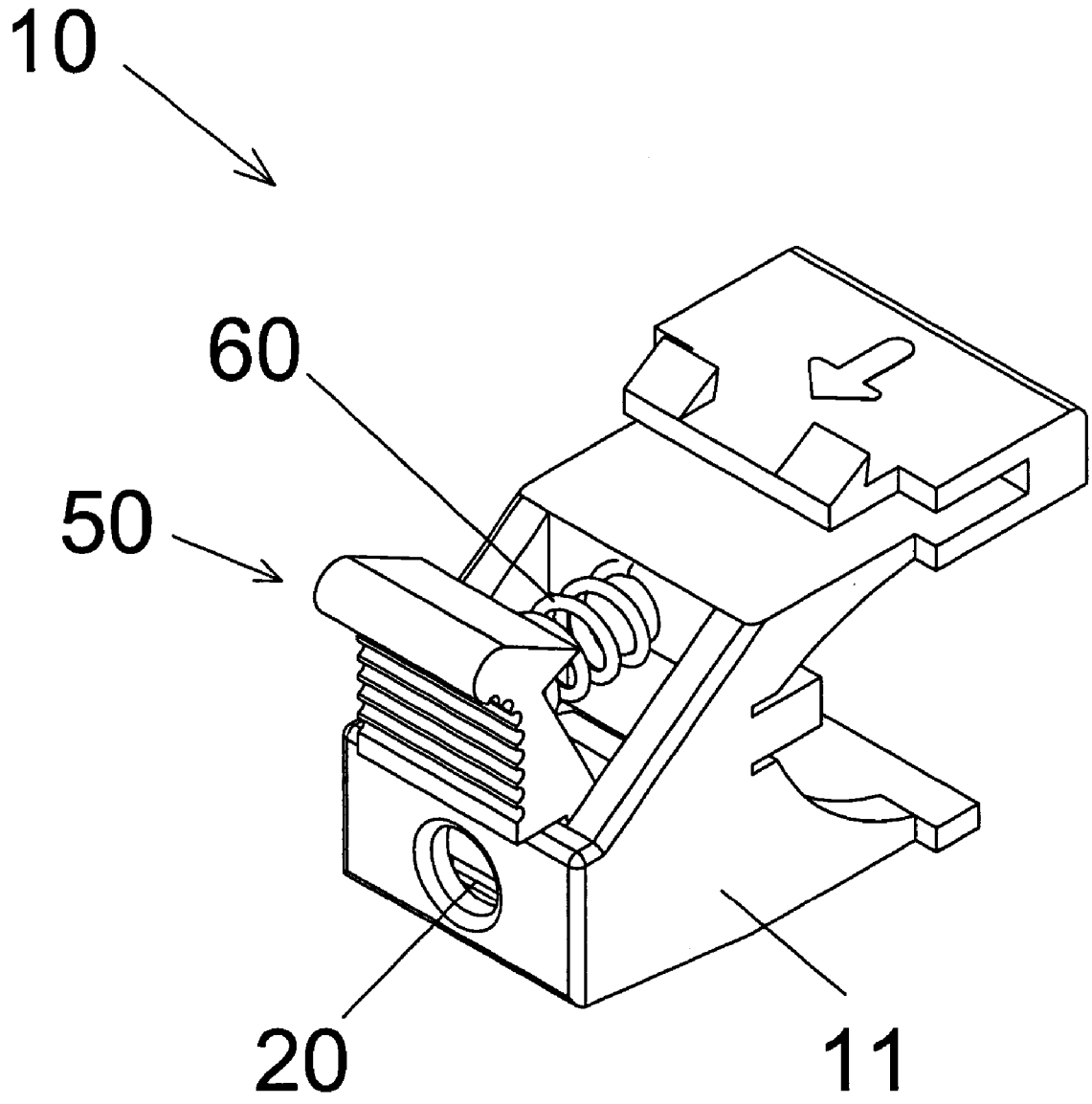
FIG. 1 is a top perspective view of a spring clip connector according to the present invention.
Figure 2:
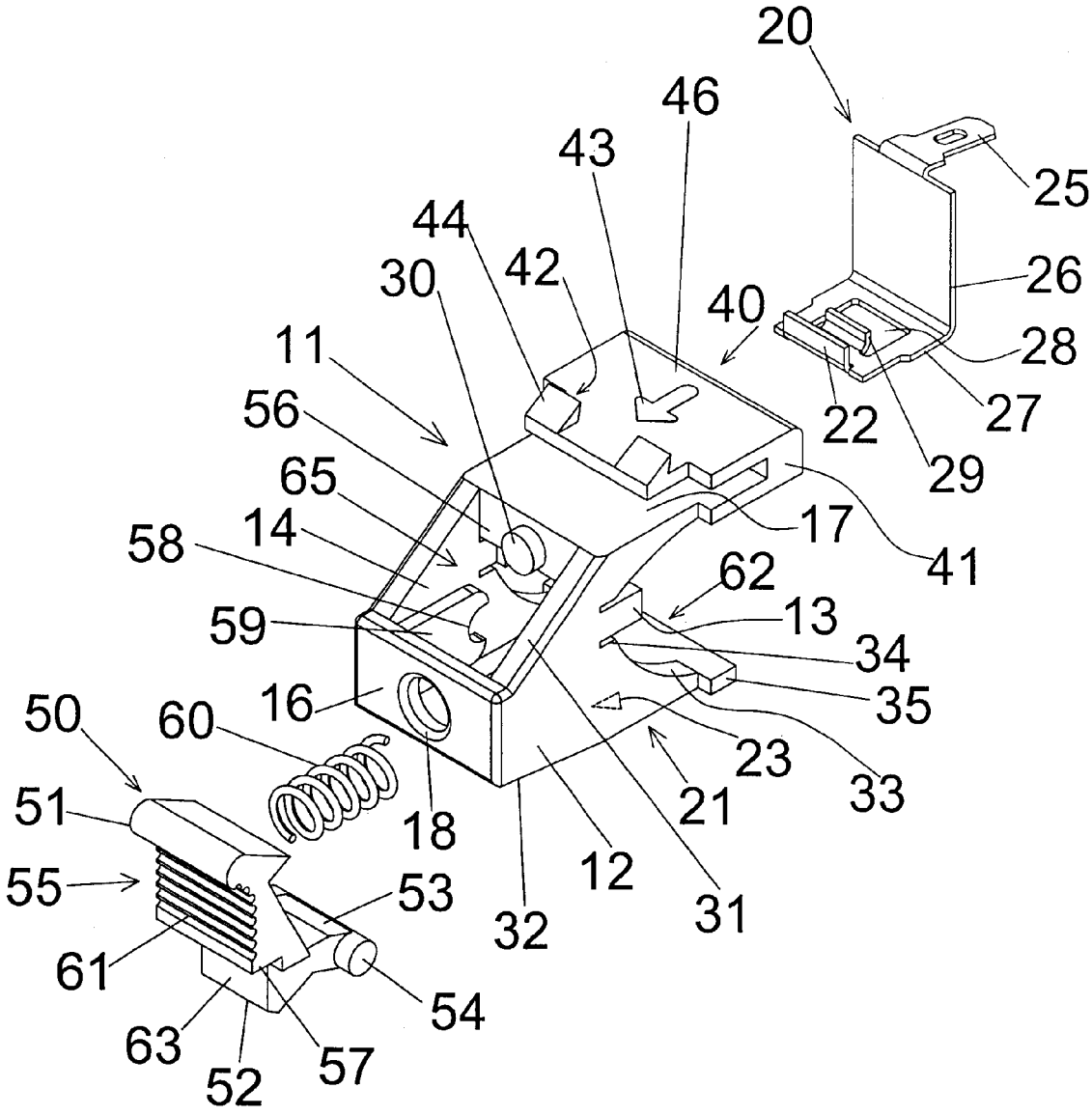
FIG. 2 is an exploded view of the spring clip connector of FIG. 1.
Figure 3:
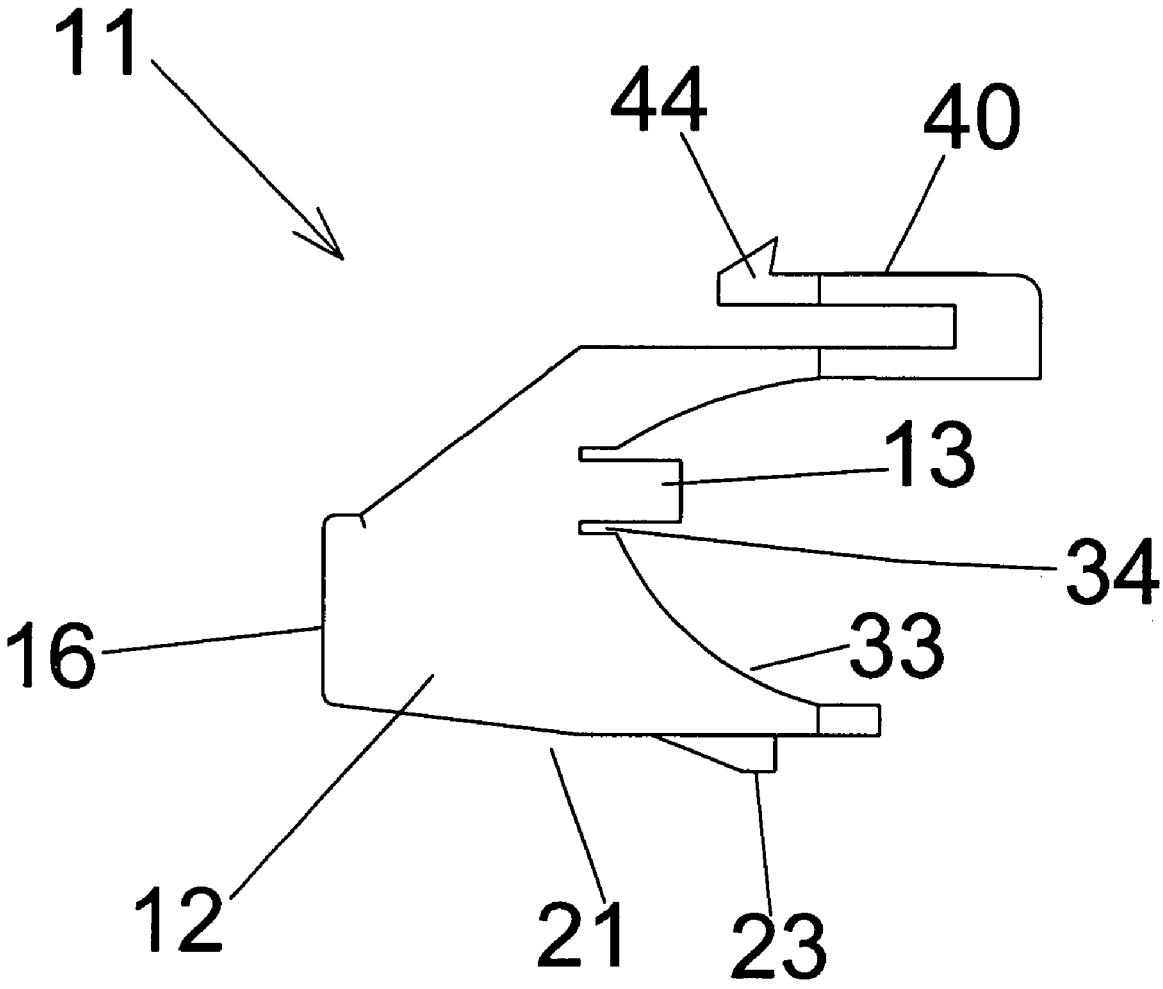
FIG. 3 is a side view of a housing of the spring clip connector.

As shown in the exemplary drawings, and with particular reference to FIG. 1, the present invention relates to a spring clip connector 10. The connector 10 is composed of a housing 11, a conductor 20, a tab 50 and a spring 60. With reference also to FIG. 2, the housing 11 of the connector 10 comprises a first side wall 12, a second side wall 14, a front wall 16, a top wall 17 and a bottom wall 21. The first and second side walls 12, 14 are parallel and spaced apart and extend between the top wall 17 and the bottom wall 21. Each side wall 12, 14 has an angled front edge 31 which extends from a top edge of the front wall 16 to a front edge of the top wall 17. Further, a bottom edge 32 of a front portion of each side wall 12, 14 is angled which allows a front portion of the housing to be more easily inserted into an outlet. The side walls 12, 14 also have a concave back edge 33 with a recess 34 housing a finger tab 13 (see FIG. 3). Finger tab 13, as described in more detail below, serves as a locking mechanism to hold the conductor 20 in the housing 11.

Extending between the first and second side walls 12, 14 is the front wall 16, which includes an opening 18 for receiving a wire therethrough. Preferably, the opening 18 is circular and centrally disposed relative to the front wall 17.

The bottom wall 21 extends rearwardly from the front wall 17 and between the two side walls 12, 14 generally conforming to the shape of the bottom edge of the side walls 12, 14. A rear portion 35 of the bottom wall 21 includes projections that extend laterally from a back edge of the side walls 12, 14 to provide additional support in securing the housing 11 to a faceplate port. Preferably, the bottom wall 21 is provided with two parallel laterally spaced ramp pieces 23 (see FIG. 3). A rectangular recess (not shown) extending from the back edge of the bottom wall is also located between the ramp pieces 23.

The top wall 17 extends rearwardly from the back of the angled front edges of side walls 12, 14. The top wall 17 is preferably provided with a latch 40. The latch includes a support wall 41 extending up from the back edge of the top wall 17 and a cantilever wall 46 extending toward the front wall 16 of the housing 11 from the support wall 41. The cantilever wall 46 includes two parallel laterally spaced ramp pieces 44. Each ramp piece 44 has a rearwardly facing vertical bearing surface 42. The latch 40 may be used for mounting the housing 11 to an outlet of a base product. It should be appreciated that any number of differing latches well known in the art may be used to secure the housing to the outlet. An arrow-shaped protrusion 43 on the cantilever latch 40 indicates the direction in which the connector 10 should be inserted into an outlet.

The front wall 16, side walls 12, 14, top wall 17 and bottom wall 21 form a cavity 62 in the housing 11. A front opening 65 to the cavity 62 is located between the top wall 17 and the front wall 16.

Preferably extending downward from the front edge of the top wall 17 is a retaining wall 56. Protruding from retaining wall 56 is a spring guide post 30.

Preferably, the inner surfaces of the first and second side walls each 12, 14 have inwardly protruding anchor supports 59 that extend from the back of the front wall 16 toward the back of the housing 11. On the back edge of each anchor support is a concave molded recess 58.

The conductor 20 is generally L-shaped having an upwardly extending rear wall 26 and a bottom wall 27 extending forwardly from a bottom edge of the rear wall 26. A primary contact 22 juts upward from the front of the bottom wall 27. An arm 25 extends rearwardly from the top of the rear wall 26 and the arm 25 may contain a hole to hook up a wire lead connection. The bottom wall 27 may also contain a centrally-disposed opening 28 as a result of the method of manufacturing. An additional contact 29 spaced from and parallel to the primary contact 22 extends upward from the front edge of the opening 28. Conductor 20 may be manufactured from tin-plated copper or any other suitable material.

The tab 50 includes an upwardly extending body 51 and a rearwardly extending foot 53. The body 51 has a front surface 55 and a back surface (not shown). The front surface 55 has ribbed gripping elements 61. The back surface has a spring guide post (not shown) extending rearwardly from it, similar to the spring guide post 30 of the retaining wall 56 of the housing 11. A front surface 63 of the foot 53 is spaced rearwardly from the front surface 55 of the body 51 to define a shelf 57 at the bottom of the body. At the bottom of the front surface 63 of the foot 53 is a conductor engaging edge 52. Protruding laterally from each side of a rear portion of the foot 53 is a pivot 54.

The connector 10 may be assembled as follows. The tab 50 is inserted into the cavity 62 through the front opening 65 of the housing 11. The pivots 54 on the tab 50 slide into the molded recesses 58. The conductor 20 is inserted into the back of the housing 11 between the top 17 and bottom 21 walls. Bottom wall 27 of conductor 20 fits between the inner surfaces of the side walls 12, 14 and is sized so that the rear wall 26 of the conductor 20 rests adjacent the pivot 54 of the tab 50 to hold the tab 50 in the molded recesses 58 and secure the tab 50 to the housing 11.

The primary contact 22 of the conductor 20 is located adjacent to and is substantially parallel to the front wall 16 of the housing 11 and, in a preferred embodiment; the leading edge of the primary contact 22 partially blocks the opening 18. The primary contact 22 and the additional contact 29 are positioned in such a manner as to assure contact with the inserted wire when the tab 50 is released and the engaging edge 52 clamps the wire down upon them. The arm 25 of the conductor 20 is located flush with the inner surface of the top wall 17 of the housing 11. The conductor 20 is secured to housing 11 by flexing the finger tabs 13 of the housing 11 outwardly during insertion of the conductor. The finger tabs 13 have angled inner walls which allows the conductor 20 to be snapped into place against the back of the retaining wall 56 of the housing 11 and retained thereon.

The spring 60 is placed between the tab 50 and the housing 11 with the spring being held in place by the guide post 30 on the housing 11 and a guide post (not shown) on the tab 50. The spring 60 rotatably biases the tab in a counterclockwise direction 50 to a closed position such that the edge 52 of the front of the foot 53 of the tab 50 will engage a wire placed through the opening 18 of the housing 11. When no wire is in place, the shelf 57 of the tab body 51 rests on the top edge of the front wall 17 of the housing 11.

The spring clip connector is operated as follows. The tab is movably coupled to the housing 11 at pivot 54 so that when rearward pressure is applied against the front surface 55 of the tab body 51, the tab moves clockwise to an open position. In the open position, spring 60 is compressed and edge 52 separates from the retaining wall 22 of the conductor 20. Movement of the tab 50 may be stopped by the spring 30 being entirely compressed and maintained between the retaining wall 56 and the tab body 51. In a preferred embodiment, the edge 52 does not block opening the 18 in the open position.

When the tab 50 is in open position, a wire may be inserted through the opening 18. Once the wire is inserted, pressure from the tab 50 may be released so that the tab 50 returns to the closed position. In the closed position, the spring-biased tab 50 presses the wire against the leading edge 22 of the conductor 20 and holds the wire firmly in place.

Figure 7:
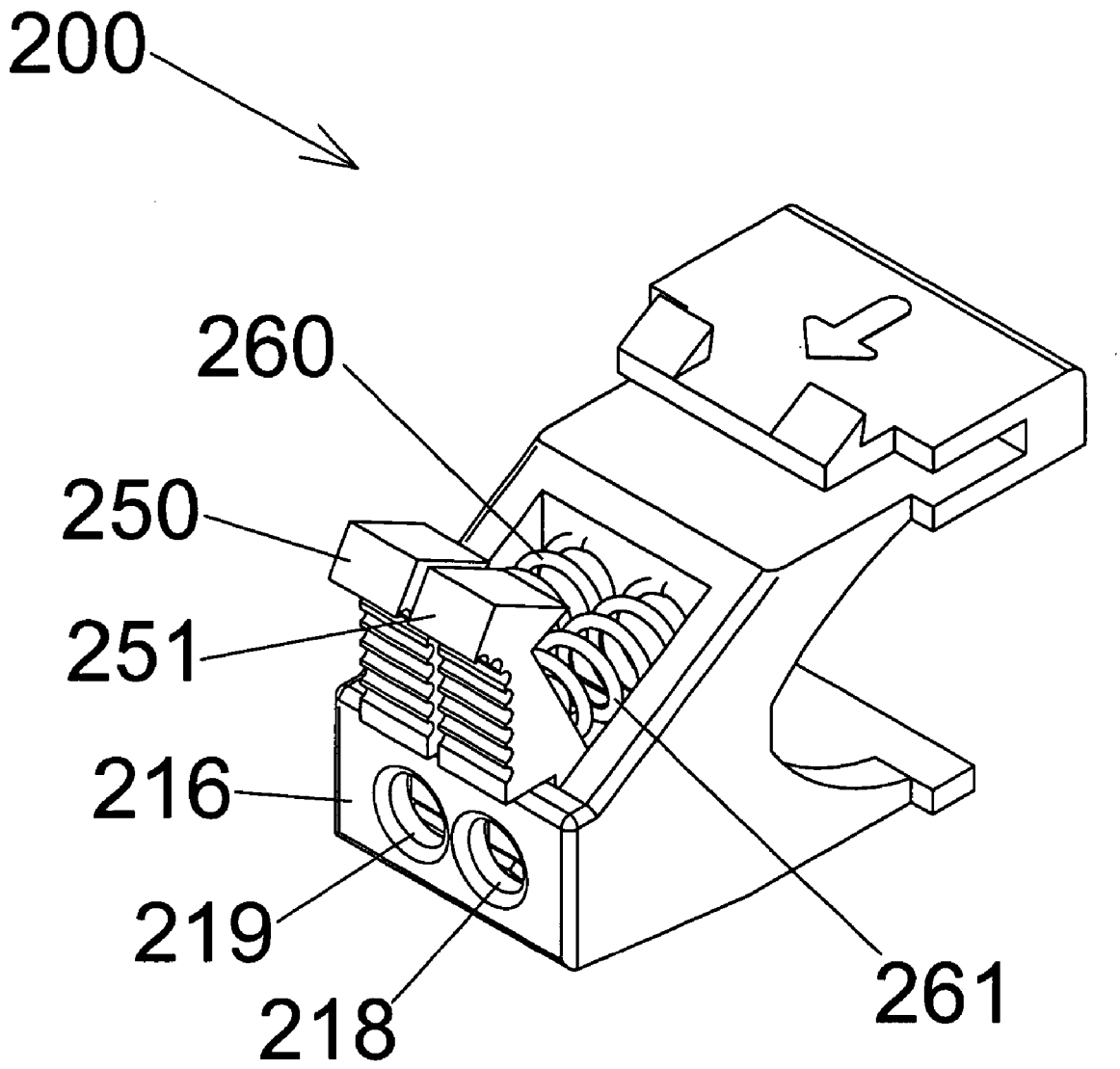
FIG. 7 is a top perspective view of an alternate embodiment of a spring clip connector according to the present invention.

FIG. 7 shows an alternate embodiment of a spring clip connector 200. The connector 200 has a faceplate 216 having two openings 218 and 219. The connector 200 also has two tabs 250 and 251, two springs 260, 261 and two conductors (not shown). In this embodiment, the two tabs pivot on a pin (not shown) that runs through an opening in the foot of each of the tabs. The connector is assembled and operated in a substantially similar manner to connector 10 described above. However, in this embodiment, the two tabs 250 and 251 may be operated independently.

Figure 4:
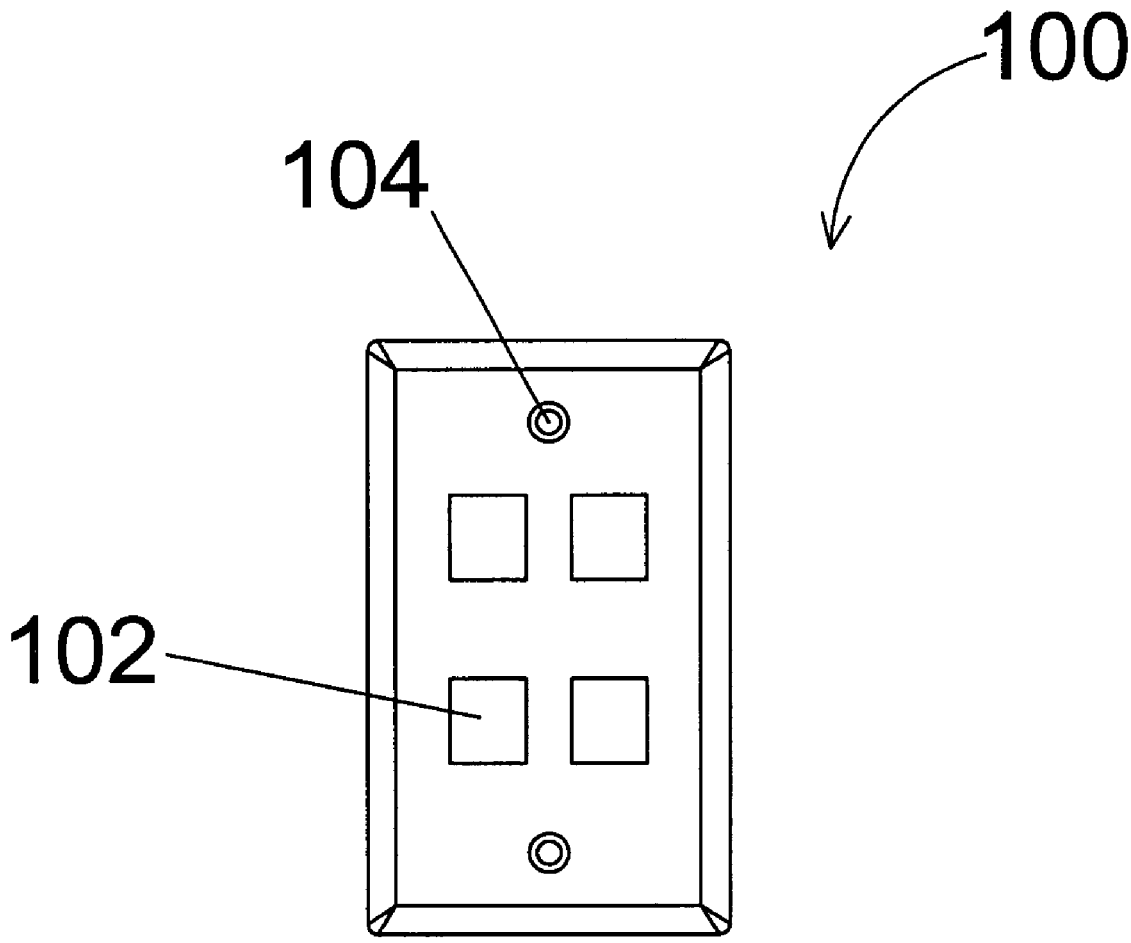
FIG. 4 is a front view of a faceplate suitable to receive a spring clip connector.
Figure 5:
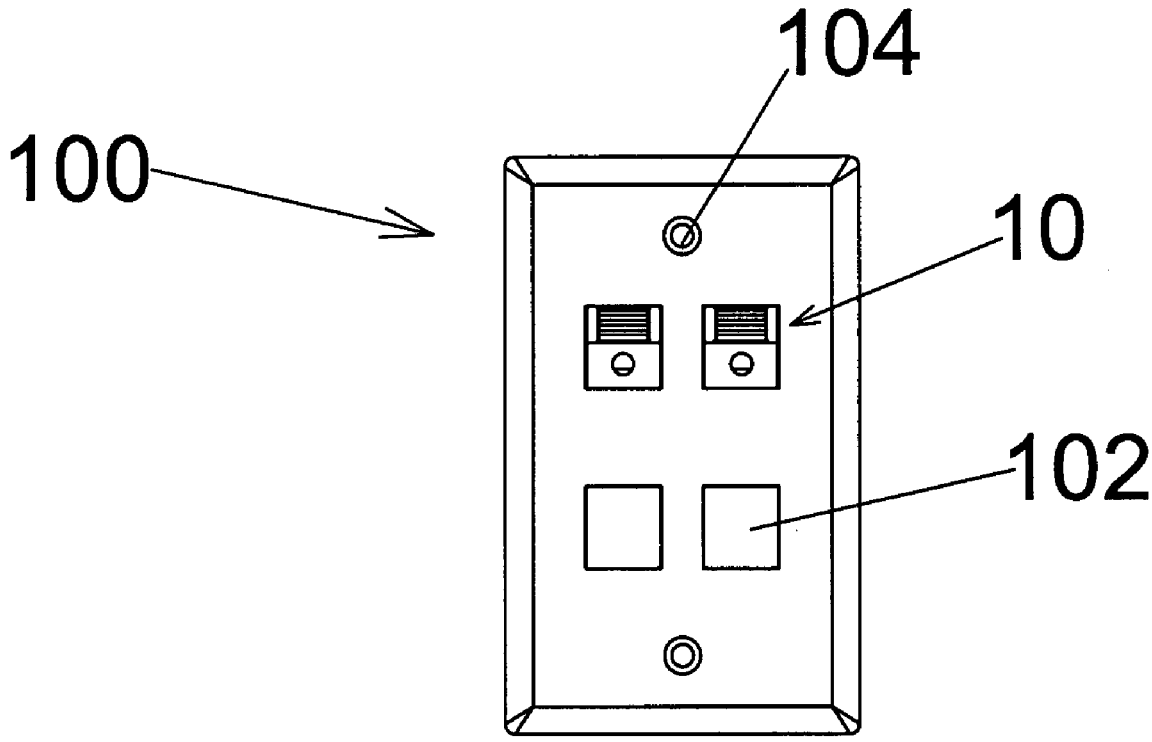
FIG. 5 is a front view of two spring clip connectors connected to a faceplate.
Figure 6:
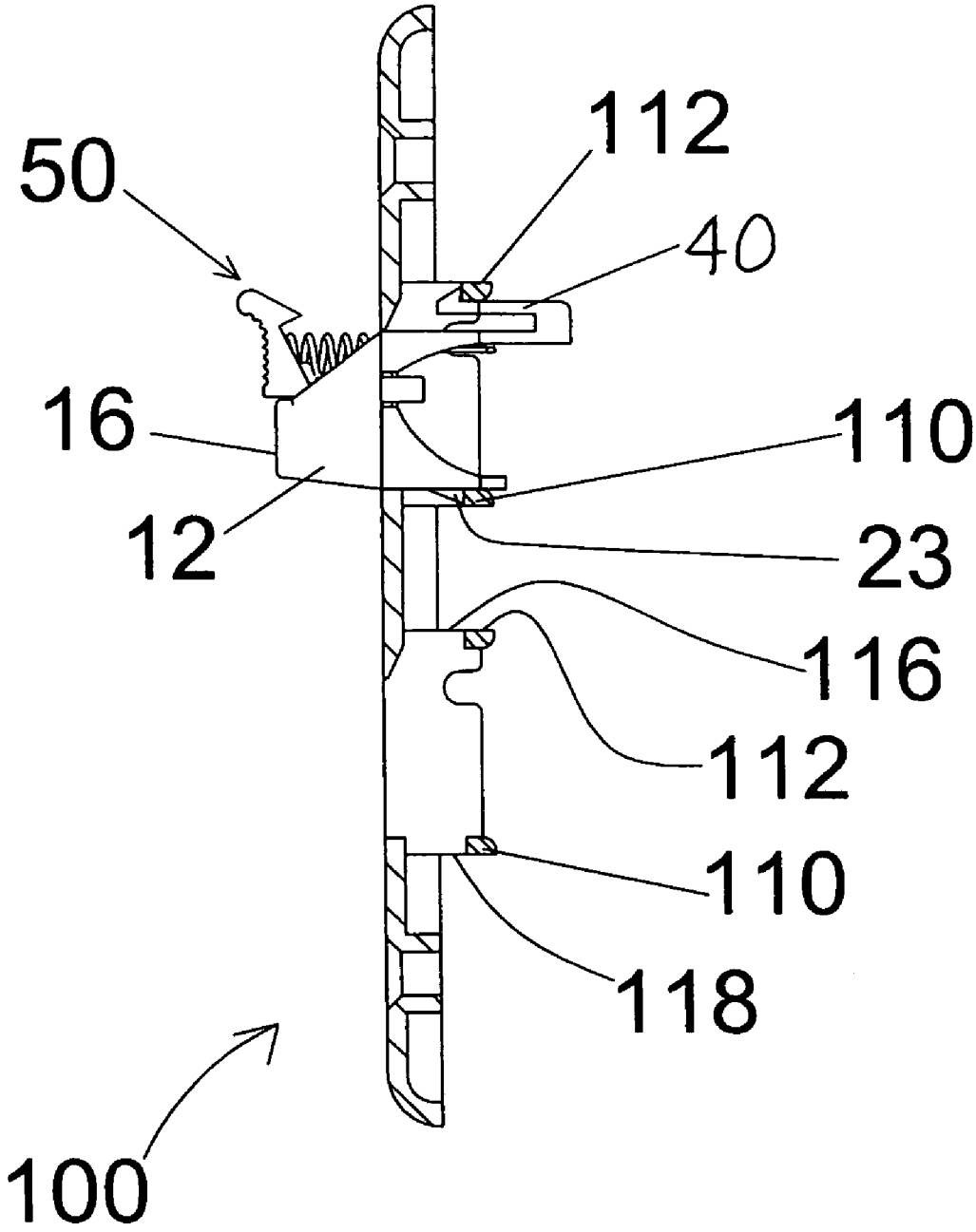
FIG. 6 is a side view of a spring clip connector connected to a faceplate.

The connector 10 is mounted to the outlet of a base product. For example, the base product may be a standard keystone faceplate 100, as shown in FIG. 4. The faceplate 100 may have one or more ports 102 which may house the connector 10 as illustrated in FIGS. 4, 5 and 6. The faceplate 100 is generally rectangular and is attached to a wall by screws 104 or other appropriate attachment means. The ports 102 of the faceplate 100 are generally square and are spaced from each other. As shown in FIG. 6, the ports 102 have a support structure extending rearwardly from the front surface of the faceplate 100 including an upper wall 116 having a top mounting surface 112 and a lower wall 118 having a bottom mounting structure.

With reference to FIG. 6, the connector 10 is mounted to a faceplate 100. The front wall 16 of the housing 11 is inserted from the rear of the faceplate 100 such that the two parallel unconnected ramp pieces 23 of the bottom wall 21 engage the bottom mounting structure 110 of the faceplate 100. The housing 11 is then rotated counterclockwise into the port 102. As the housing 11 is rotated, the latch 40 deflects and the vertical bearing surface 42 engages the top mounting surface 112 of the faceplate and secures the housing 11 to the port 102 of the faceplate 100. It should be appreciated that this illustrates only one possible method that may be used to mount the housing 11 to a faceplate 100. Many other methods are possible. It should be appreciated that any number of differing latches well known in the art may be used to secure the housing to the outlet and that the mounting of housings into the outlet of a base product is well known in the art.

Although the invention has been described in detail with reference to only a few preferred embodiments, those having ordinary skill in the art will appreciate that various modifications can be made without departing from the spirit of the invention. For example, it should be understood that the connector may be inserted into a variety of different outlets and base products.

We claim:

1. A spring clip connector assembly comprising:

a faceplate comprising a front facing surface and a rear facing surface and an opening through the faceplate, and a spring clip connector including a housing having a front facing wall with an opening for receiving a wire therethrough, a movable tab located in the housing, the movable tab having a handle portion for an operator to move the tab and a contact portion, a conductor secured to the housing and having a contact positioned to engage a wire inserted through the opening in the front facing wall, and a spring, the front facing wall and the handle portion of the tab configured to be inserted through the opening of the faceplate;

wherein one of the housing and the rear facing surface of the faceplate includes a resilient member and the other of the housing and the rear facing surface of the faceplate includes a mounting surface, the resilient member movable between a first position that permits insertion of the front facing wall and the handle portion of the tab through the opening of the faceplate in a direction from the rear facing surface of the faceplate to the front facing surface of the faceplate and a second position that engages the mounting surface and blocks removal of the front facing wall and the handle portion of the tab back through the opening of the faceplate to form a snap lock connection, and wherein the tab is movable between a closed position such that the contact portion of the tab is adjacent to the contact to secure the wire inserted through the opening in the front facing wall against the contact and an open position such that the contact portion of the tab is farther away from the contact than in the closed position to release the wire, the spring biasing the tab toward the closed position.

2. The connector assembly according to claim 1 wherein the faceplate has two screw holes.

3. The connector assembly according to claim 1 wherein the mounting surface includes a top mounting surface and a bottom mounting surface on the faceplate.

4. The connector assembly according to claim 1 wherein the resilient member is a cantilever latch on the housing.

5. The connector assembly according to claim 1 wherein the contact partially blocks the opening in the front wall.

6. The connector assembly according to claim 1 wherein the housing has a single opening.

7. The connector assembly according to claim 1 wherein the front wall has two openings.

8. The connector assembly according to claim 1 wherein the housing includes the resilient member and the faceplate includes the mounting surface.

9. The connector assembly according to claim 1 wherein a portion of the tab partially blocks the opening in the front wall.

10. The connector assembly of claim 1, wherein the tab is configured to be smaller than a front opening of the housing adjacent the front wall of the housing such that the tab is insertable through the front opening.

11. The connector assembly of claim 1, wherein the housing includes a resilient finger tab to engage and secure the conductor to the housing.

12. The connector assembly of claim 1, wherein the spring is a coil spring.

13. The connector assembly of claim 1, wherein the conductor includes an upwardly extending rear wall and a bottom wall extending forward from a bottom edge of the rear wall.

14. The connector assembly of claim 13, wherein the housing includes a resilient finger tab to engage the upwardly extending rear wall and secure the conductor to the housing.

15. A spring clip connector assembly comprising:

a faceplate having an opening, a spring clip connector located in the opening of the faceplate, the spring clip connector comprising a housing having a front wall with an opening for receiving a wire therethrough, a movable tab located in the housing, and a conductor secured to the housing and having a contact positioned to engage a wire inserted through the opening in the front wall, and a spring engaging the tab, and not engaging the faceplate, to bias the tab to a closed position wherein the housing includes a resilient member and the faceplate includes a mounting surface, the resilient member movable between a first position that permits insertion of the housing through the opening of the faceplate and a second position that engages the at least one mounting surface and blocks removal of the housing from the opening of the faceplate to form a snap lock connection, and wherein the tab is movable between the closed position such that a portion of the tab is adjacent to the contact to secure the wire inserted through the opening in the front wall against the contact and an open position such that the portion of the tab is farther away from the contact than in the closed position to release the wire, the spring biasing the tab toward the closed position.

16. The spring clip connector assembly of claim 15, wherein the face plate comprises a second opening and a second spring clip connector located in the second opening.

17. The spring clip connector assembly of claim 15, further comprising a second opening on the front wall.

18. A method for securing a spring clip connector to a faceplate having at least one opening, a bottom mounting structure and a top mounting surface, the spring clip connector comprising a housing having two spaced-apart side walls and a front wall having an opening for receiving a wire therethrough, a bottom wall and a top wall that are spaced apart, a latch piece for engaging the faceplate a conductor secured to the housing and positioned adjacent to the opening in the front wall to engage the wire, a tab movably coupled to the housing having a closed position to secure the wire to the conductor, and a spring engaging the tab to bias the tab to the closed position, the method comprising:

inserting the front wall of the housing through the opening of the faceplate and moving the front wall of the housing to a first position relative to the faceplate, the front wall in the first position being spaced apart from the faceplate by a first distance, and moving the front wall of the housing to a second position relative to the faceplate to engage the latch piece with the faceplate, the front wall in the second position being spaced apart from the faceplate by a second distance;

wherein the second distance is greater than the first distance.

19. The method of claim 18, further comprising a second opening on the front wall.

20. The method of claim 18, further comprising a second tab located in the housing.

21. A spring clip connector assembly comprising:

a faceplate comprising a front facing surface and a rear facing surface and an opening through the faceplate, and a spring clip connector including a housing structure having an exterior surface and a front facing wall with an opening for receiving a wire therethrough and a second opening, a movable tab located in the housing structure, the movable tab having a handle portion accessible at the second opening for an operator to move the tab and a contact portion, a conductor secured to the housing structure and having a contact positioned to engage a wire inserted through the opening in the front facing wall, and a spring in contact with both the tab and the housing structure, the front facing wall and the handle portion of the tab projecting through the opening of the faceplate and the housing structure mechanically coupled by a latch place to the faceplate on the rear facing surface side of the faceplate;

wherein the tab is movable between a closed position such that the contact portion of the tab is adjacent to the contact to secure a wire inserted through the opening in the front facing wall against the contact and an open position such that the contact portion of the tab is farther away from the contact than in the closed position to release the wire, the spring biasing the tab toward the closed position.

* * * * *